US011417946B2

(12) United States Patent
Yanagisawa

(10) Patent No.: US 11,417,946 B2
(45) Date of Patent: Aug. 16, 2022

(54) ELECTRONIC TIMEPIECE

(71) Applicant: Seiko Epson Corporation, Tokyo (JP)

(72) Inventor: Toshiaki Yanagisawa, Suwa (JP)

(73) Assignee: Seiko Epson Corporation

( * ) Notice: Subject to any disclaimer, the term of this patent is extended or adjusted under 35 U.S.C. 154(b) by 817 days.

(21) Appl. No.: 16/292,431

(22) Filed: Mar. 5, 2019

(65) Prior Publication Data

US 2019/0280371 A1 Sep. 12, 2019

(30) Foreign Application Priority Data

Mar. 6, 2018 (JP) ..... JP2018-039611
Nov. 12, 2018 (JP) ..... JP2018-212164

(51) Int. Cl.

| | |
|---|---|
| ***H01Q 1/27*** | (2006.01) |
| ***G04G 21/04*** | (2013.01) |
| ***H01Q 9/04*** | (2006.01) |
| ***G04G 17/04*** | (2006.01) |
| ***H01Q 1/42*** | (2006.01) |

(52) U.S. Cl.

CPC ..... *H01Q 1/273* (2013.01); *G04G 17/04* (2013.01); *G04G 21/04* (2013.01); *H01Q 9/0407* (2013.01); *H01Q 1/42* (2013.01)

(58) Field of Classification Search

CPC ..... G04R 60/12; G04R 60/00; G04R 20/04; G04R 60/02; G04R 60/10; G04G 17/04; G04G 21/04; H01Q 9/0407; H01Q 1/42; H01Q 1/273; H01Q 1/38; G04B 19/247; G04B 19/24

See application file for complete search history.

(56) References Cited

U.S. PATENT DOCUMENTS

2010/0060540 A1* 3/2010 Abe ..... H01Q 1/273 343/788
2010/0097896 A1* 4/2010 Baba ..... G04R 20/04 368/205
2014/0086027 A1* 3/2014 Yanagisawa ..... G04B 37/0033 368/278
2015/0016229 A1* 1/2015 Yanagisawa ..... G04R 60/10 368/47
2016/0103428 A1 4/2016 Fujisawa
2016/0103429 A1* 4/2016 Fujisawa ..... G04B 19/247 368/278
2016/0161920 A1* 6/2016 Fujisawa ..... G04G 17/04 368/80
2017/0040681 A1 2/2017 Fujisawa

FOREIGN PATENT DOCUMENTS

JP 2014-062849 A 4/2014
JP 2016-080356 A 5/2016
JP 2017-037057 A 2/2017

* cited by examiner

*Primary Examiner* — Edwin A. Leon
(74) *Attorney, Agent, or Firm* — Harness, Dickey & Pierce, P.L.C.

(57) ABSTRACT

An electronic timepiece includes a cylindrical case body, a rear cover that covers an opening of the case body, a patch antenna, and an antenna holder that presses the antenna against the main plate in a direction from the rear cover to the main plate, in which the patch antenna has a radiation element provided on an antenna radiation surface located on an opposite side to a surface facing the rear cover and a first step provided on the antenna radiation surface, and the main plate has a second step provided at a position corresponding to the first step.

12 Claims, 9 Drawing Sheets

ELECTRONIC TIMEPIECE

BACKGROUND

1. Technical Field

The present invention relates to an electronic timepiece having a planar antenna embedded therein.

2. Related Art

In an electronic timepiece having a global positioning system (GPS) receiving function using a patch antenna according to the related art, as disclosed in JP-A-2016-80356, a planar antenna is mounted on a circuit board, and the planar antenna is disposed by fixing the circuit board to a main plate. Thus, a covered portion of the main plate is disposed to planarly overlap an exposed surface on which an antenna electrode of the planar antenna is not disposed, so that movement of the planar antenna is restricted.

However, when an electronic timepiece is thinned, a covered portion of a main plate is thinned, and when the electronic timepiece falls, the main plate is damaged due to impact, and impact resistance deteriorates.

SUMMARY

An electronic timepiece according to an aspect of the invention includes: a cylindrical case; a rear cover that covers an opening of the case; an antenna; a main plate that is fixed to the case; and an antenna holder that presses the antenna against the main plate in a direction from the rear cover to the main plate, in which the antenna has a radiation element provided on an antenna radiation surface located on an opposite side to a surface facing the rear cover and a first step provided on the antenna radiation surface, and the main plate has a second step provided at a position corresponding to the first step.

According to the electronic timepiece, the antenna holder presses the antenna against the main plate side and presses the first step provided on the antenna radiation surface against the second step of the main plate so that the antenna is held. Thus, the main plate can be made thicker by the height of the first step of the antenna. Accordingly, degradation of the impact resistance can be suppressed.

In another preferable aspect, at least a part of the case is made of metal, the antenna holder is made of metal, and the antenna holder is electrically connected to the case.

According to the aspect, since the antenna can be electrically connected to the case through the antenna holder, an operation of the antenna can be stabilized.

In another preferable aspect, the rear cover and the antenna holder are made of metal, and the antenna holder is electrically connected to the rear cover.

According to the aspect, since the antenna can be electrically connected to the rear cover through the antenna holder, an operation of the antenna can be stabilized.

In another preferable aspect, the electronic timepiece further includes a flexible board having a first ground electrode provided on a surface closer to the antenna than to the rear cover and a second ground electrode provided on a surface closer to the rear cover than to the antenna, the flexible board being disposed between the antenna and the rear cover, in which the antenna has a third ground electrode, the first ground electrode and the third ground electrode are connected to each other, and the second ground electrode and the rear cover are electrically connected to each other through the antenna holder.

According to the aspect, the third ground electrode of the antenna can be grounded to the case or the rear cover through the flexible board and the antenna holder.

In another preferable aspect, the electronic timepiece further includes a flexible board on which the antenna is mounted, and a circuit board on which a circuit that performs communication using the antenna is provided and which is electrically connected to the flexible board.

According to the aspect, since the antenna is connected to the circuit board through the flexible board, the position of the circuit board can be freely changed with respect to the position of the antenna, and the thickness of the movement including the circuit board can be reduced. Further, since the antenna is mounted on the flexible board, when a problem occurs in the antenna, the flexible board on which the antenna is mounted may be replaced, and it is not required to replace an expensive circuit board. Thus, cost risk can be reduced.

There are various aspects for realizing power supply from the circuit board to the antenna. In a preferable aspect, the flexible board and the circuit board are electrically connected to each other through a first power supply connector mounted on the flexible board and a second power supply connector mounted on the circuit board.

In another preferable aspect for realizing power supply from the circuit board to the antenna, in a plan view along the normal direction of the antenna radiation surface, the first power supply connector mounted on the flexible board and the second power supply connector mounted on the circuit board overlap with the antenna holder. The antenna holder may be in contact with the flexible board or may be separated from the flexible board. When the antenna holder is separated from the flexible board, it is preferable that the shortest distance between the antenna holder and the flexible board is shorter.

According to the aspect, when the antenna holder and the flexible board are in contact with each other, even if a force for separation from the second power supply connector is applied to the first power supply connector due to impact or vibration, a normal force corresponding to the separation force described above is generated from the antenna holder so that separation of the first power supply connector from the second power supply connector can be suppressed.

Further, even when the antenna holder and the flexible board are separated from each other, when the antenna holder or the flexible board moves due to impact or vibration so that the antenna holder and the flexible board come into contact with each other, even if a force for separation from the second power supply connector is applied to the first power supply connector, a normal force corresponding to the separation force described above is generated from the antenna holder so that separation of the first power supply connector from the second power supply connector can be suppressed.

In another preferable aspect for realizing electric power supply from the circuit board to the antenna, the antenna holder presses the first power supply connector against the second power supply connector in a direction from the rear cover to the main plate.

In this aspect, even when a force for separation from the second power supply connector is applied to the first power supply connector due to the impact or vibration, the separation force is relaxed or canceled out due to a normal stress caused by pressing of the antenna holder. Thus, separation of the first power supply connector from the second power supply connector can be suppressed, as compared to a case where the antenna holder is not pressed.

In another preferable aspect for realizing power supply from the circuit board to the antenna, the flexible board and the circuit board are electrically connected to each other by bringing a first power supply electrode mounted on the flexible board and a second power supply electrode mounted on the circuit board into contact with each other.

In a preferable aspect, in a plan view along the normal direction of the antenna radiation surface, the circuit board and the antenna do not overlap each other.

According to the aspect, mutual interference between the antenna and a reception circuit of the circuit board can be suppressed.

In a preferable aspect, the electronic timepiece has a dial plate provided to face the antenna radiation surface, in which a distance between the antenna radiation surface and the dial plate is longer than a distance between a placement surface of a date wheel and the dial plate in the main plate.

According to the aspect, reception performance of a reception circuit that performs reception using the antenna can be improved.

In a preferable aspect, the antenna is a patch antenna.

According to the aspect, an electronic timepiece equipped with a patch antenna can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a first embodiment will be described with reference to the drawings.

Figure 1:
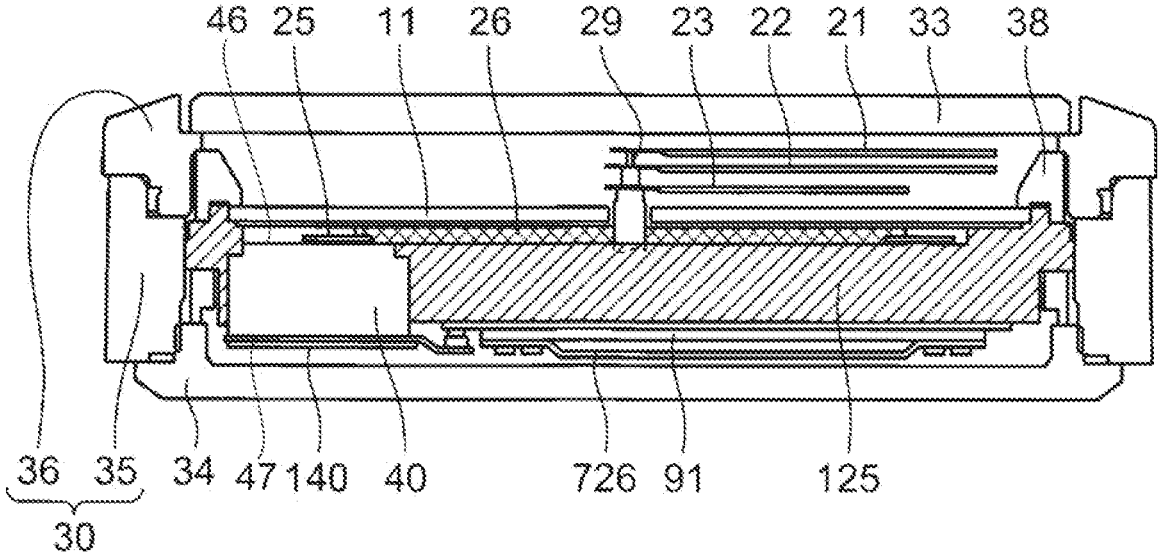
FIG. 1 is a sectional view illustrating a schematic configuration of an electronic timepiece according to a first embodiment.
Figure 2:
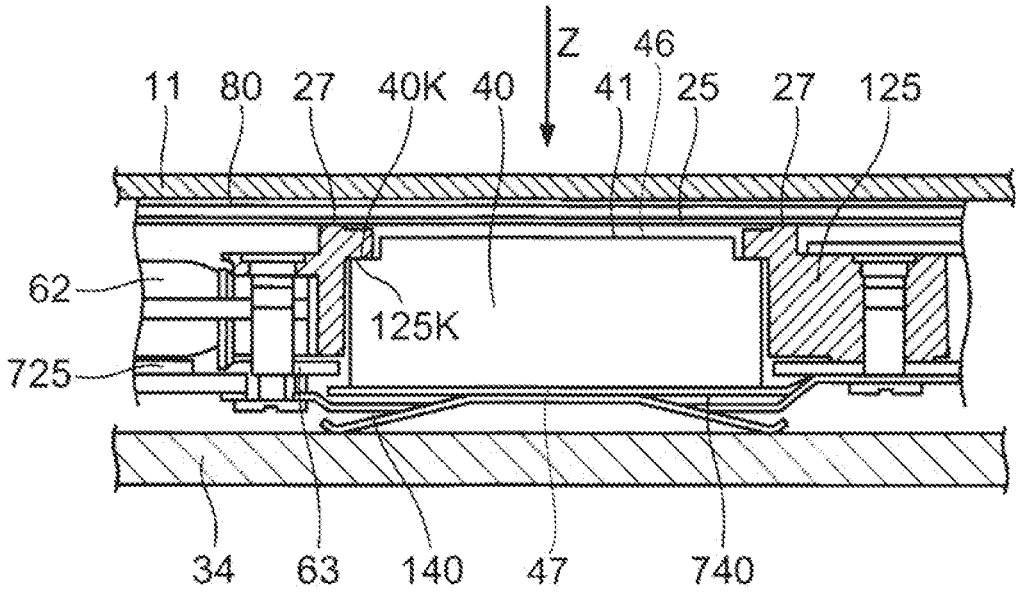
FIG. 2 is a sectional view illustrating a detailed configuration near a patch antenna.

FIG. 1 is a sectional view illustrating a schematic configuration of an electronic timepiece according to a first embodiment. Further, FIG. 2 is a sectional view illustrating a configuration near a patch antenna 40 of an electronic timepiece in detail. In the following description, when a positional relationship between parts is described, terms such as "upper" or "front" mean a cover glass 33 side, and terms "lower" or "rear" mean a rear cover 34 side.

The electronic timepiece includes an exterior case 30, a cover glass 33, and a metallic rear cover 34, as illustrated in FIG. 1. Among two openings of the exterior case 30, an opening on a front surface side is closed by the cover glass 33, and an opening on a rear surface side is closed by the rear cover 34. At least a part of the exterior case 30 is made of metal.

The exterior case 30 is configured with a metallic cylindrical case body 35 and an annular glass edge 36 placed thereon. An annular dial ring 38 is disposed on an inner periphery of the glass edge 36. Further, a main plate 125 is fixed to the case body 35. A dial plate 11 is disposed on an upper surface side of the main plate 125. A pointer shaft 29 passes through a hole formed in the plane center of the dial plate 11, and a second hand 21, a minute hand 22, and an hour hand 23 are attached to the pointer shaft 29. A date wheel 25 is disposed on an upper surface of the main plate 125. As illustrated in FIG. 2, a panel-like solar cell 80 is disposed on a lower surface side of the dial plate 11, and the date wheel 25 is below the solar cell 80. The date wheel 25 is placed on a date wheel mounted surface 27 provided on the upper surface of the main plate 125. Thus, as illustrated in FIG. 1, the date wheel 25 is pressed by a date wheel holder 26 on a lower surface side of the dial plate 11.

The main plate 125 includes a driving mechanism having a motor 62 for driving the second hand 21, the minute hand 22, the hour hand 23, and the date wheel 25, and a train wheel. The motor 62 in the driving mechanism and a conductive portion 63 through which the motor 62 is electrically connected to a circuit board 725 are illustrated in FIG. 2.

A controller that controls driving of the motor 62 and a circuit that supplies power to the patch antenna 40 and performs communication using the patch antenna 40 are mounted on the circuit board 725. The circuit corresponds to a receiving circuit for receiving a GPS satellite signal or the like. The patch antenna 40 is an example of a planar antenna.

An anti-magnetic plate 91 that shields an external magnetic field to prevent malfunction of the motor is disposed on a lower surface side of the main plate 125. The anti-magnetic plate 91 is made of metal. A circuit holder 726 is sandwiched between the anti-magnetic plate 91 and the rear cover 34.

The patch antenna 40 is inserted into a space provided in the main plate 125 from the rear cover 34 side. The patch antenna 40 is pressed toward the dial plate 11 by the antenna holder 140 supported on the surface of the main plate 125 on the side of the rear cover 34. In other words, the antenna holder 140 presses an antenna against the main plate 125 in a direction from the rear cover 34 to the main plate 125.

In more detail, as illustrated in FIG. 2, the patch antenna 40 is soldered and mounted on a flexible board 740. Hereinafter, the flexible board 740 is simply referred to as a flexible printed circuit (FPC) board 740. A first ground electrode is provided on a front surface of the FPC board 740, and a second ground electrode is provided on a rear surface thereof. The front surface of the FPC board 740 is an example of a surface closer to the patch antenna 40 than to the rear cover 34. Similarly, the rear surface of the FPC board 740 is an example of a surface closer to the rear cover 34 than to the patch antenna 40. The first ground electrode and the second ground electrode are electrically connected to each other. The patch antenna 40 includes a third ground electrode. When the patch antenna 40 is soldered to the FPC board 740, the third ground electrode is electrically connected to the first ground electrode on the front surface of the FPC board 740. Thus, the antenna holder 140 made of metal is sandwiched between the FPC board 740 and the rear cover 34. The antenna holder 140 made of metal electrically connects the second ground electrode of the FPC board 740 and the rear cover 34, thereby generating a repulsive force for separating the FPC board 740 and the rear cover 34 from each other. A first step 40K is provided at an edge on an upper surface of the patch antenna 40. Further, a second step 125K corresponding to the first step 40K of the patch antenna 40 is formed on the main plate 125. The first step 40K and the second step 125K performs positioning of the patch antenna 40. The patch antenna 40 presses the first step 40K against the second step 125K of the main plate 125 by the repulsive force generated by the antenna holder 140, and is fixed at a position apart from the dial plate 11 by a certain distance. In the first embodiment, as illustrated in FIG. 2, the shapes of the first step 40K and the second step 125K are determined such that the antenna radiation surface 46 in which a radiation element 41 of the patch antenna 40 is located is situated at a position further from the dial plate 11 side than the date wheel mounted surface 27 on which a placement surface of the date wheel 25 is located, by a predetermined distance.

In the first embodiment, as illustrated in FIG. 2, the patch antenna 40 and the circuit board 725 are regions not overlapping each other in a plan view seen along a normal direction Z of the antenna radiation surface 46 of the patch antenna 40. This is to prevent mutual interference between the patch antenna 40 and a reception circuit provided on the circuit board 725 to receive a GPS satellite signal using the patch antenna 40.

Figure 3:
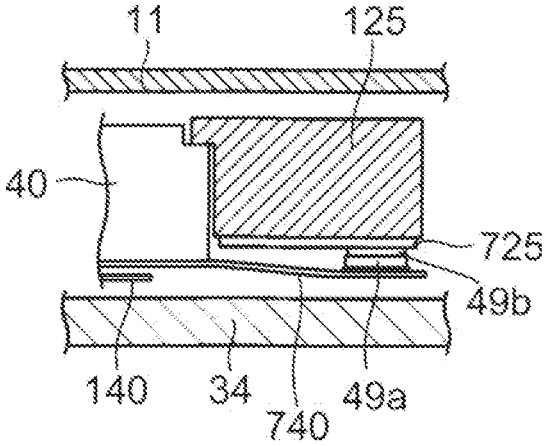
FIG. 3 is a diagram illustrating an example of a mode in which the patch antenna is connected to a circuit board.
Figure 4:
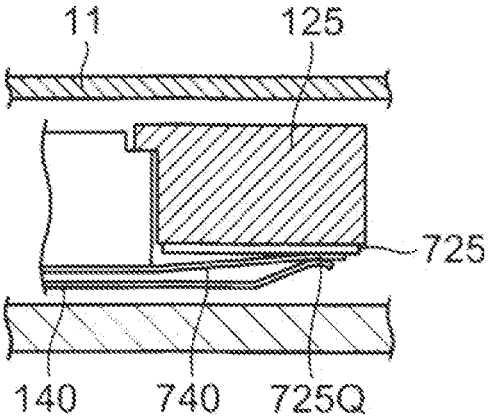
FIG. 4 is a diagram illustrating another example of a mode in which the patch antenna is connected to a circuit board.

FIGS. 3 and 4 illustrate modes for electrical connection between the FPC board 740 and the circuit board 725. In the mode illustrated in FIG. 3, an electrode on the FPC board 740 is connected to a power supply connector 49*b* provided on the circuit board 725 through a power supply connector 49*a*. The power supply connector 49*a* is an example of a first power supply connector. Similarly, the power supply connector 49*b* is an example of a second power supply connector. In the mode illustrated in FIG. 4, the FPC board 740 is crimped at a power supply point 725Q on the circuit board 725 by the antenna holder 140 without a connector. Further, the power supply point 725Q, which is a second power supply electrode, also functions as a ground electrode. A first power supply electrode is formed on the FPC board 740. The first power supply electrode also functions as a ground electrode. The first power supply electrode and the second power supply electrode formed on the FPC board 740 and the circuit board 725, respectively, come into contact with each other so that the FPC board 740 and the circuit board 725 are electrically connected to each other. In the first embodiment, the patch antenna 40 is connected to the circuit board 725 through the FPC board 740 having flexibility. Therefore, the position of the circuit board 725 in the normal direction of the dial plate 11 can change regardless of the position of the antenna radiation surface 46 of the patch antenna 40. Thus, thinning of a movement including the circuit board 725 can be realized.

Figure 5A:
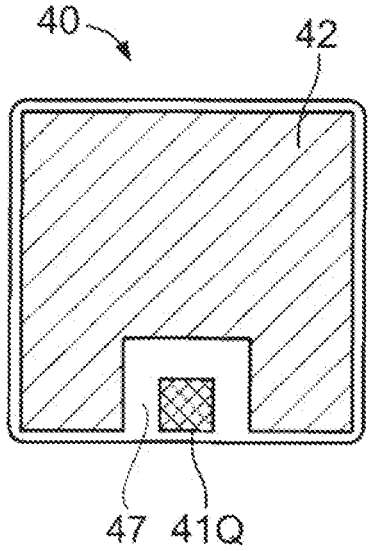
FIG. 5A is a plan view illustrating the patch antenna when viewed from a grounding surface.
Figure 5B:
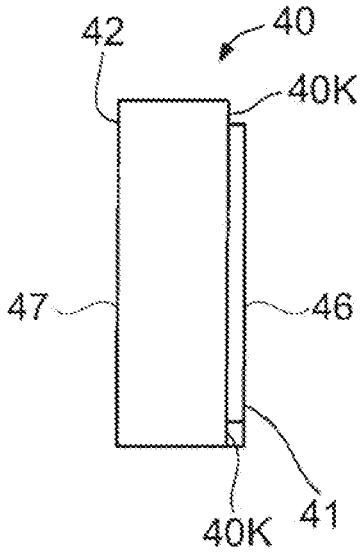
FIG. 5B is a side view illustrating the patch antenna.
Figure 5C:
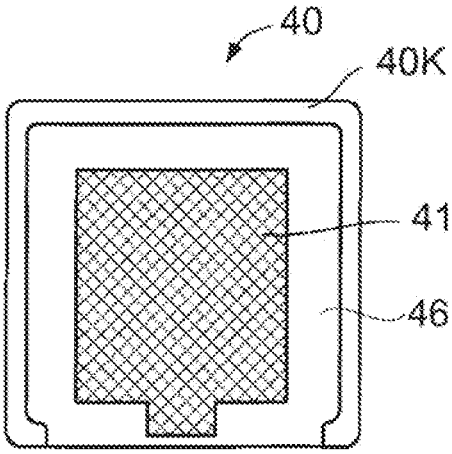
FIG. 5C is a plan view illustrating the patch antenna when viewed from an antenna radiation surface.

FIGS. 5A, 5B, and 5C are diagrams illustrating a configuration example of the patch antenna 40 according to the first embodiment. The patch antenna 40 is a square plate-shaped antenna having a grounding surface and the antenna radiation surface 46. The grounding surface is an example of a surface 47 facing the rear cover 34. The antenna radiation surface 46, which is a surface facing the dial plate 11, is an example of a surface that is opposite to the grounding surface. FIG. 5A is a plan view illustrating the grounding surface, FIG. 5C is a plan view illustrating the antenna radiation surface 46, and FIG. 5B is a side view. As illustrated in FIG. 5A, a square-shaped radiation element power supply electrode 41Q is formed at the center of one side of the grounding surface. Thus, a ground electrode 42 is formed to surround the radiation element power supply electrode 41Q from three directions at a fixed distance. When the FPC board 740 of the patch antenna 40 is soldered, the ground electrode 42 is electrically connected to a ground electrode of the FPC board 740, and the radiation element power supply electrode 41Q is electrically connected to a power supply electrode provided at a position facing the radiation element power supply electrode 41Q of the FPC board 740. Further, as illustrated in FIG. 5C, a radiation element 41 having a shape having a projection portion protruding outward from the center of one side of a square electrode pattern retreated inward from four sides by a predetermined distance is provided on the antenna radiation surface 46. Here, the projection portion of the radiation element 41 faces the radiation element power supply electrode 41Q, and both the projection portion and the radiation element power supply electrode 4 are electromagnetically coupled to each other. The GPS satellite signal received by the radiation element 41 is supplied to the reception circuit on the circuit board 725 through the electromagnetic coupling between the projection portion of the radiation element 41 and the radiation element power supply electrode 41Q and a power supply pattern on the FPC board 740. The surface of the patch antenna 40 on which the radiation element 41 is provided is the antenna radiation surface 46.

In the first embodiment, as illustrated in FIG. 5C, the first step S40K is formed on three sides, that is, three positions, excluding one side facing the projection portion of the radiation element 41 among four sides of the antenna radiation surface 46 of the patch antenna 40. As illustrated in FIG. 2, the first step 40K is pressed against the second step 125K of the main plate 125, so that positioning of the patch antenna 40 is performed. As illustrated in FIG. 2, the first step 40K and the second step 125K overlap each other in a plan view seen along the normal direction Z.

Figure 6:
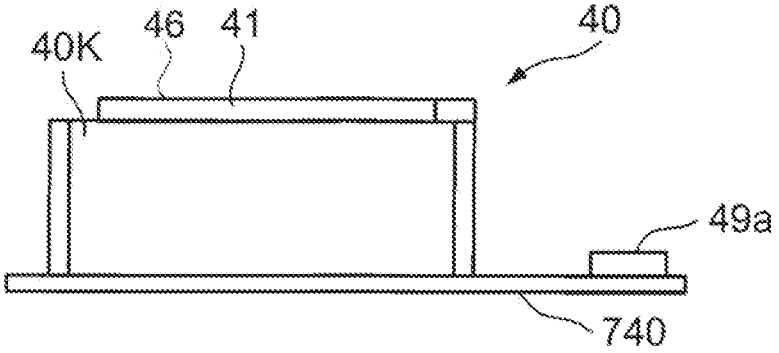
FIG. 6 is a side view illustrating an FPC board on which the patch antenna is mounted.
Figure 7:
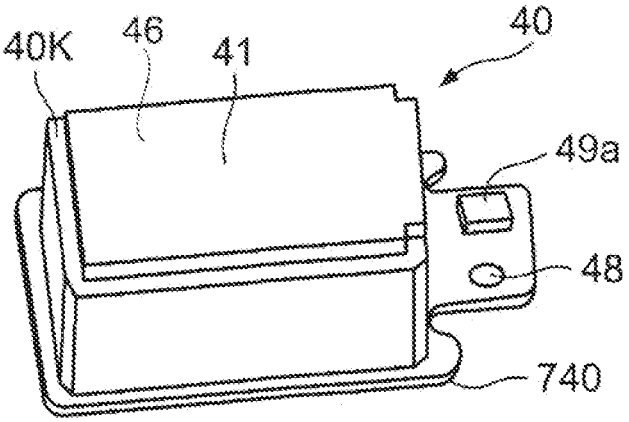
FIG. 7 is a perspective view illustrating the FPC board when viewed from an oblique upper side.
Figure 8:
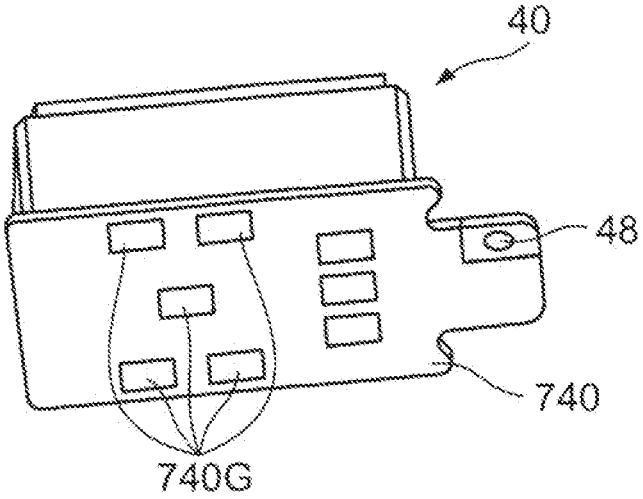
FIG. 8 is a perspective view illustrating the FPC board when viewed from an oblique lower side.

FIG. 6 is a side view illustrating an antenna unit in which the patch antenna 40 is mounted on the FPC board 740, FIG. 7 is a perspective view illustrating the antenna unit when viewed from an oblique upper side, and FIG. 8 is a perspective view illustrating the antenna unit when viewed from an oblique lower side. In the first embodiment, the antenna unit illustrated in FIGS. 6 to 8 is manufactured in advance through soldering and is integrated in an electronic timepiece.

As illustrated in FIGS. 6 to 8, the power supply connector 49*a* is disposed on a surface of the FPC board 740 on which the patch antenna 40 is mounted, and a hole 48 for screw fixing is opened. In this example, a screw is fastened to a screw pin erected on the main plate 125 through the hole 48, so that the power supply connector 49*a* is pressed against the power supply connector 49*b* provided on the circuit board 725. The screw pin is a female screw because the screw pin has a spiral on an inner diameter thereof. Illustration of the screw pin is omitted. As illustrated in FIG. 8, a ground electrode 740G is formed on the rear surface of the FPC board 740, and the ground electrode 740G is electrically connected to the ground electrode formed on the front surface of the FPC board 740. Illustration of the ground electrode is omitted. The ground electrode 42 of the patch antenna 40 is connected to the ground electrode on the front surface of the FPC board 740, and the ground electrode 740G on the rear surface of the FPC board 740 is electrically connected to a case through the antenna holder 140. After the timepiece is manufactured, when a problem occurs in the patch antenna 40, the antenna unit may be replaced. Replacement of the expensive circuit board 725 is not required.

Figure 9A:
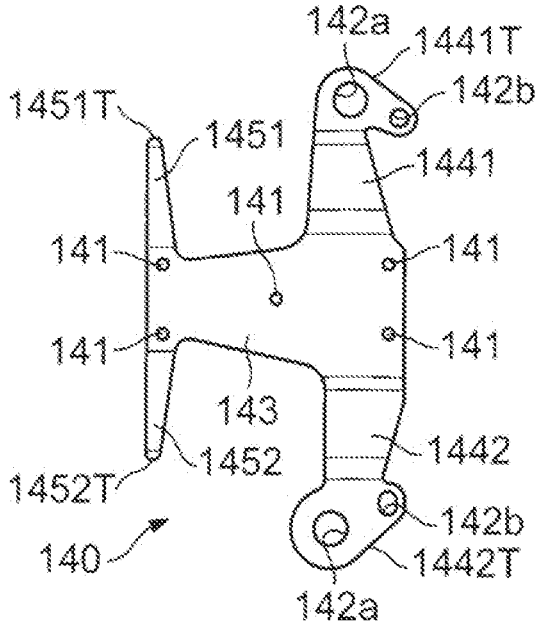
FIG. 9A is a plan view illustrating an antenna holder.
Figure 9B:
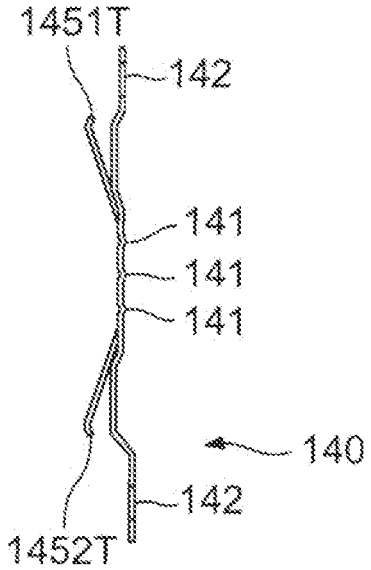
FIG. 9B is a side view illustrating the antenna holder.
Figure 10:
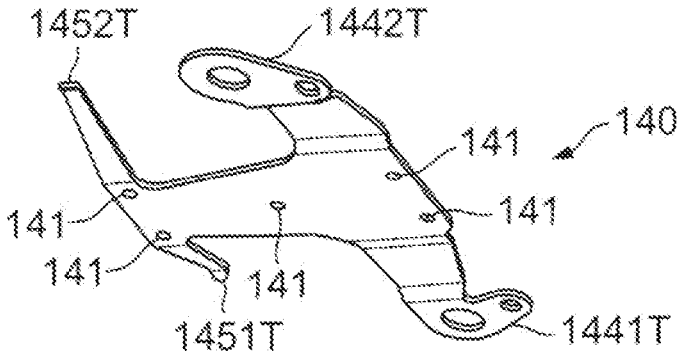
FIG. 10 is a perspective view illustrating the antenna holder when viewed from the patch antenna side.
Figure 11:
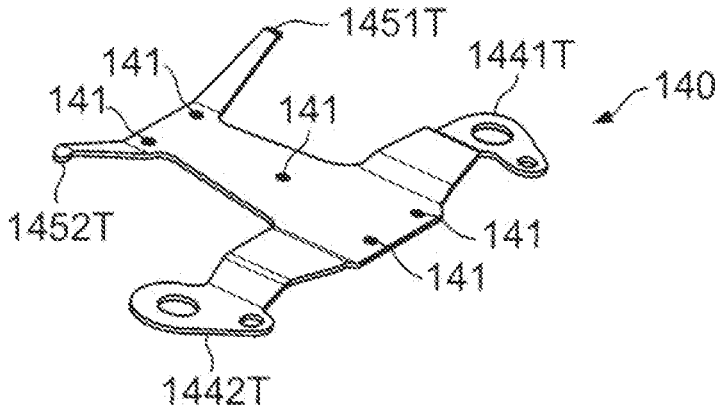
FIG. 11 is a perspective view illustrating the antenna holder when viewed from the rear cover side.

FIG. 9A is a plan view illustrating the antenna holder 140, and FIG. 9B is a side view illustrating the antenna holder 140. FIG. 10 is a perspective view illustrating a side surface of the antenna holder 140, which faces the patch antenna 40. Further, FIG. 11 is a perspective view illustrating a side surface of the antenna holder 140, which faces the rear cover 34.

As illustrated in the drawing, the antenna holder 140 has a central support 143 which is a portion to be pressed against the patch antenna 40, a pair of legs 1441 and 1442 extending from opposite sides of the central support 143 in a width direction while being bent at one end of the central support 143, and a pair of legs 1451 and 1452 extending from opposite sides of the central support 143 in the width direction at the other end of the central support 143.

Protrusions 141 extending in an opposite direction to the patch antenna 40 are provided at total five positions including one position at the center and four positions in surrounding areas in the central support 143. A tip end of the leg 1441 is a rounded connection end portion 1441T. A fixing hole 142*a* and a positioning hole 142*b* are formed in the connection end portion 1441T. A tip end of the leg 1442 is a rounded connection end portion 1442T. A fixing hole 142*a* and a positioning hole 142*b* are also formed in the connection end portion 1442T. The connection end portions 1441T and 1442T are connection end portions for connection to the main plate 125. The legs 1441 and 1442 are bent such that the connection end portions 1441T and 1442T are in surface contact with the circuit board 725.

The legs 1451 and 1452 are bent in the same direction as illustrated in FIG. 9B. The bending direction of the legs 1451 and 1452 is a direction of the rear cover 34. Tip ends of the legs 1451 and 1452 are bent to become connection end portions 1451T and 1452T. The connection end portions 1451T and 1452T are portions that are pressed against the rear cover 34.

Figure 12:
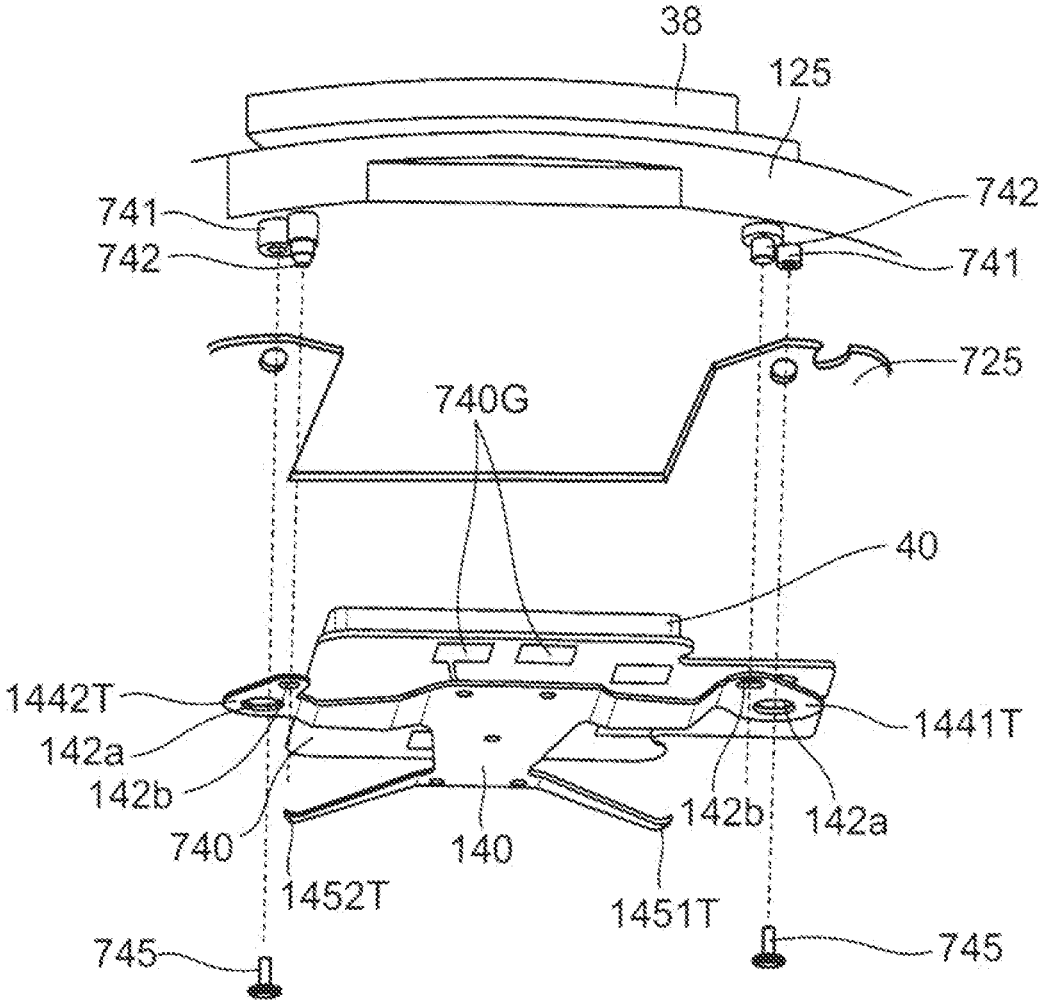
FIG. 12 is an assembling view illustrating a state in which the antenna holder is mounted on a main plate.

FIG. 12 is an assembling view illustrating a state in which the antenna holder 140 is mounted on the main plate 125. As illustrated in FIG. 12, a pair of fixing screw pins 741 and a pair of positioning protrusion 742 are erected on opposite sides of an accommodation space of the patch antenna 40 in a periphery of the main plate 125. The fixing screw pins 741 are female screws because the fixing screw pins 741 have spirals on inner diameters thereof. In the first embodiment, as illustrated in FIG. 12, the pair of fixing screw pins 741 of the main plate 125 pass through the pair of fixing holes 142*a* of the antenna holder 140, and the pair of positioning protrusions 742 of the main plate 125 pass through the pair of positioning holes 142*b* of the antenna holder 140. Thus, the pair of fixing screw pins 741 are fastened to the pair of fixing holes 142*a* through screws 745.

When the antenna holder 140 made of metal is fixed to the main plate 125, the protrusion 141 of the central support 143 of the antenna holder 140 is pressed against the ground electrode 740G on a lower surface of the FPC board 740 on which the patch antenna 40 is mounted, due to spring property of the antenna holder 140. Thus, when a lower opening of the case body 35 is closed by the rear cover 34, the connection end portions 1451T and 1452T of the antenna holder 140 are pressed against the rear cover 34 by the spring property of the antenna holder 140. As a result, the ground electrode of the FPC board 740 is electrically connected to the rear cover 34 through the protrusion 141 of the antenna holder 140, the antenna holder 140, and the connection end portions 1451T and 1452T of the antenna holder 140, so that the ground electrode of the FPC board 740 is grounded. Here, the rear cover 34 is electrically connected to the case body 35 made of metal. Therefore, an entire case including the rear cover 34 and the case body 35 has a ground potential. Since the antenna holder 140 is made of metal, the antenna holder 140 is electrically connected to the case, so that an operation of the patch antenna 40 can be stabilized.

Hereinabove, the electronic timepiece according to the first embodiment has been described.

According to the first embodiment, a part of the outer side of the radiation element 41 on the antenna radiation surface 46 of the patch antenna 40 is pressed against the main plate 125, so that a positional relationship between the solar cell 80 near the surface of the dial plate 11, the date wheel 25, and the driving mechanism is fixed. Here, in order to improve reception performance, it is preferable that the antenna radiation surface 46 of the patch antenna 40 is disposed on the dial plate 11 side as much as possible.

When the patch antenna 40 is mounted on the circuit board 725, a positional variation of the antenna radiation surface 46 with the dial plate 11 as a reference is obtained by adding a positional variation in the circuit board 725 determined by a thickness variation in the main plate 125, a thickness variation in the antenna, and a variation in a height at which the antenna is mounted. As a result, reception performance greatly varies. In contrast, in the first embodiment, since the patch antenna 40 is pressed against the main plate 125 as described above, a variation in the position of the antenna radiation surface 46 can be reduced. As a result, according to the first embodiment, a variation in the reception performance can be reduced.

Further, in order to improve the reception performance, it is preferable that the antenna radiation surface 46 of the patch antenna 40 is disposed on the dial plate 11 side as much as possible. As a result, a protrusion constituting a reception surface of the patch antenna 40 provided in the main plate 125 becomes thinner, and thus it is impossible to cope with an impact received by the movement when the electronic timepiece falls, and the like. However, in the first embodiment, the first step 40K is provided in the patch antenna 40, and is put on the second step 125K of the main plate 125, so that while the antenna radiation surface 46 of the patch antenna 40 is placed as much as possible on the dial plate 11 side, the thickness of the main plate 125 that can withstand a drop impact is ensured.

Further, in the first embodiment, the patch antenna 40 is mounted on the FPC board 740 to constitute the antenna unit, and the FPC board 740 is connected to the circuit board 725. When the patch antenna 40 is mounted on the circuit board 725, the height of the circuit board 725 is determined by the thickness of the patch antenna 40. Further, since a component such as the circuit holder 726 is stacked on the rear cover side of the circuit board 725, the thickness of the movement increases, which may damage the marketability.

With this configuration, since the height of the circuit board 725 is not influenced by the height of the antenna of the antenna unit, the movement can be thinned. Further, since the height of the FPC board 740 can be freely changed, power supply forms such as supply of electric power to the antenna using the connector and supply of electric power to the antenna by bringing the FPC board 740 into direct contact with the circuit board 725 can be freely selected.

Further, in the first embodiment, when the height of a power supply portion of the patch antenna 40 changes due to dimensional variations of components or the height of the power supply portion of the patch antenna 40 changes due to impact or vibration, since the FPC board 740 absorbs the change, reliability of a power supply connection portion is advantageously improved.

Further, according to the first embodiment, when a problem occurs in the patch antenna 40, if the antenna unit may be replaced, it is unnecessary to replace the expensive circuit board 725 on which a control IC for driving a timepiece and a reception module for controlling a receiving function are mounted. Thus, according to the first embodiment, a cost risk can be reduced.

Further, according to the first embodiment, when a problem occurs in the antenna unit, the antenna unit can be replaced only by loosening and removing the screw 745. In this way, in order to replace the antenna unit, it is not necessary to disassemble the expensive circuit board 725, a maintenance property can be improved, and a risk that a timepiece performance decreases can be reduced.

Hereinabove, although the first embodiment has been described, other embodiments can be conceived. For example, the other embodiments will be described as follows.

In the second embodiment, in a mode illustrated in FIG. 3, the antenna holder 140 presses the power supply connector 49*a* against the power supply connector 49*b* in a direction from the rear cover 34 to the main plate 125. Hereinafter, the second embodiment will be described. In modes and variations described below, an element having the same effect and function as those of the first embodiment is designated by the same reference numeral as the first embodiment, and detailed description thereof will be omitted.

Figure 13:
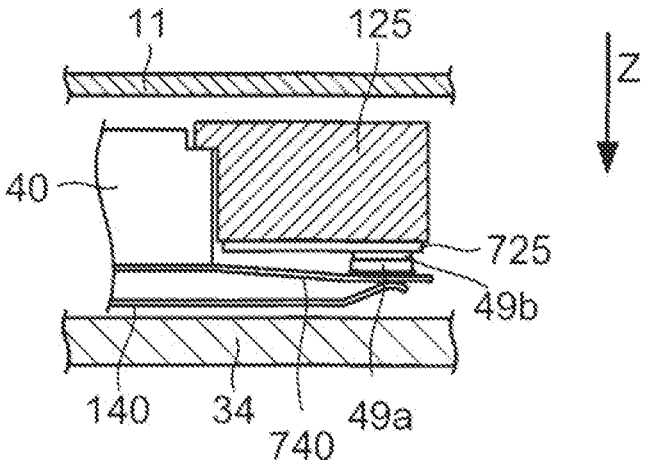
FIG. 13 is a diagram illustrating another example of a mode in which a patch antenna is connected to a circuit board according to a second embodiment.

FIG. 13 is a diagram illustrating another example of a mode in which the patch antenna 40 is connected to the circuit board 725 according to the second embodiment. Similarly to the mode illustrated in FIG. 3, in a mode illustrated in FIG. 13, an electrode of the FPC board 740 is connected to the power supply connector 49*b* through the power supply connector 49*a*. Further, the antenna holder 140 presses the power supply connector 49*a* against the power supply connector 49*b* in a direction from the rear cover 34 to the main plate 125. In the second embodiment, in a plan view along the normal direction Z, the power supply connector 49*a* and the power supply connector 49*b* overlap with the antenna holder 140. Here, a part of the power supply connector 49*a* and the power supply connector 49*b* may overlap with the antenna holder 140 or the entirety of the power supply connector 49*a* and the power supply connector 49*b* may overlap with the antenna holder 140.

Hereinabove, the electronic timepiece according to the second embodiment has been described.

According to the second embodiment, the antenna holder 140 presses the power supply connector 49*a* against the power supply connector 49*b* in a direction from the rear cover 34 to the main plate 125. In this configuration, even when a force for separation from the power supply connector 49*b* is applied to the power supply connector 49*a* due to the impact or vibration on the electronic timepiece, the separation force is relaxed or canceled out due to a normal stress caused by pressing of the antenna holder 140. Thus, separation of the power supply connector 49*a* from the power supply connector 49*b* can be suppressed.

Further, the FPC board 740 may be pulled toward the patch antenna 40 due to the impact and vibration on the electronic timepiece. In this case, a force perpendicular to the normal direction Z is applied to the power supply connector 49*a*. In the second embodiment, since a frictional force proportional to a normal stress is generated due to the pressing of the antenna holder 140, even when a force perpendicular to the normal direction Z is applied, the separation of the power supply connector 49*a* from the power supply connector 49*b* can be suppressed.

In a third embodiment, conduction between the FPC board 740 and the circuit board 725 can be checked. Hereinafter, the third embodiment will be described. In modes and variations described below, an element having the same effect and function as those of the second embodiment is designated by the same reference numeral as the second embodiment, and detailed description thereof will be omitted.

Figure 14:
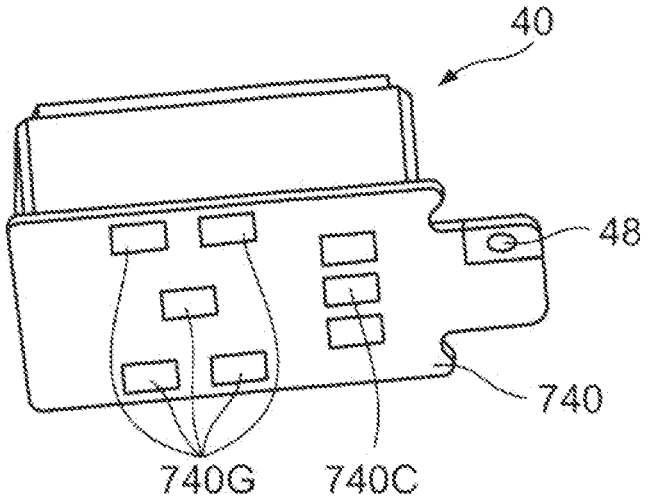
FIG. 14 is a perspective view illustrating an FPC board according to a third embodiment when viewed from an oblique lower side.

FIG. 14 is a perspective view illustrating an FPC board 740 according to a third embodiment when viewed from an oblique lower side. As illustrated in FIG. 14, a ground electrode 740G and a conduction check terminal 740C are formed on the rear surface of the FPC board 740.

Figure 15:
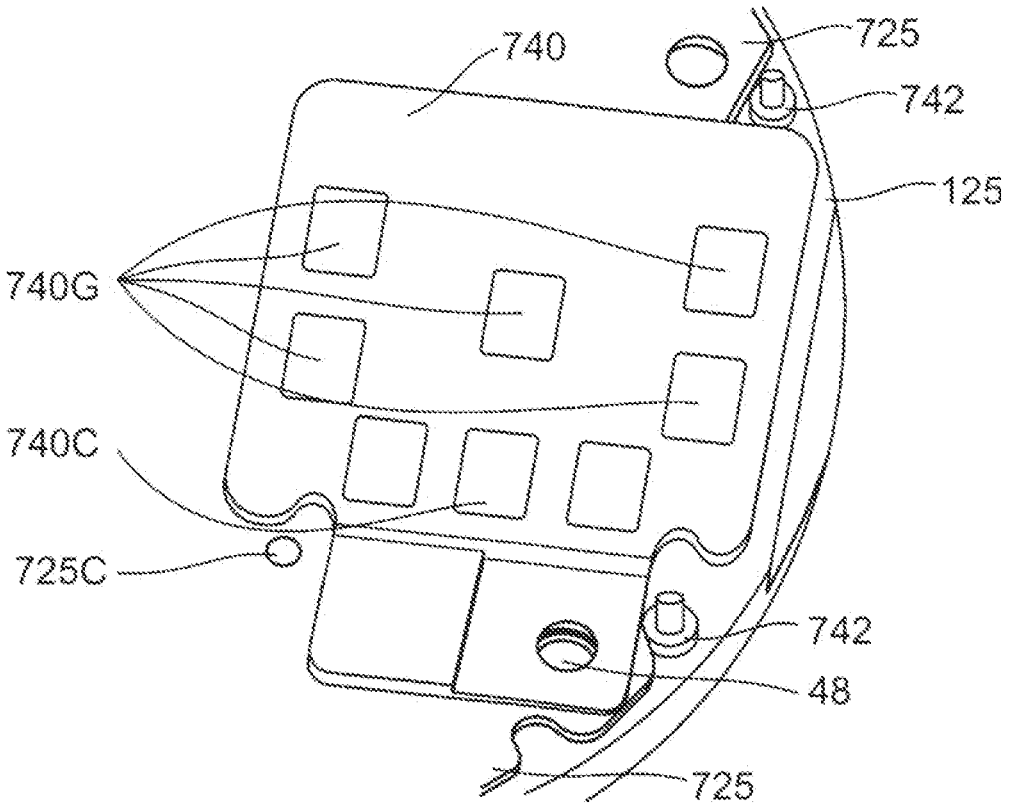
FIG. 15 is a perspective view illustrating a state in which an antenna unit is installed in the circuit board.

FIG. 15 is a perspective view illustrating a state in which an antenna unit is installed in the circuit board 725. As illustrated in FIG. 15, a conduction check terminal 725C is formed on the circuit board 725.

Figure 16:
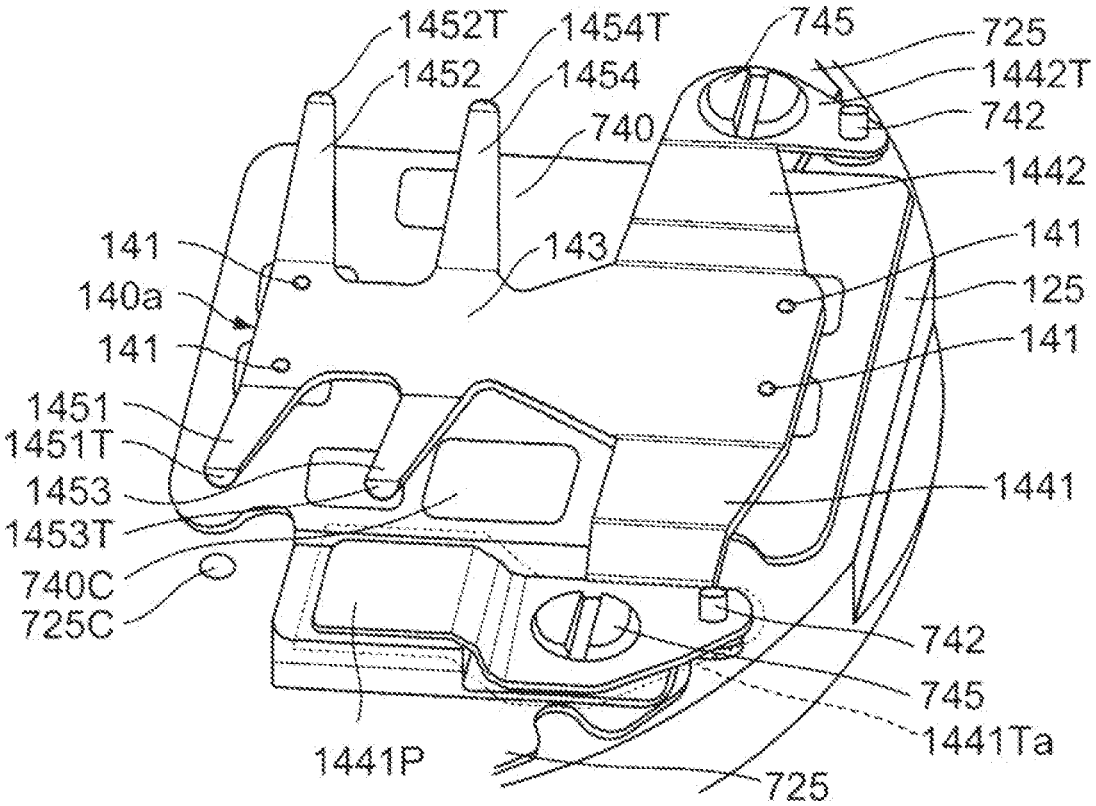
FIG. 16 is a perspective view illustrating an example in which the antenna holder has been mounted on the main plate according to the third embodiment.

FIG. 16 is a perspective view illustrating an example in which the antenna holder 140*a* is mounted on the main plate 125 according to the third embodiment. Hereinafter, only a difference between an antenna holder 140*a* and the antenna holder 140 illustrated in FIG. 9 will be described. The antenna holder 140*a* has a pair of legs 1453 and 1454 extending from the center of the central support 143 to opposite sides of the central support 143 in a width direction.

Protrusions 141 protruding in an opposite direction to the patch antenna 40 is provided at four end portions in the central support 143 of the antenna holder 140*a*. A tip end of the leg 1441 is a connection end portion 1441Ta. A pressing portion 1441P extending from the leg 1441 toward the leg 1451 is formed in the connection end portion 1441Ta. The connection end portion 1441Ta is bent toward the rear cover 34. A tip end of the connection end portion 1441Ta toward the leg 1451 is bent to form the pressing portion 1441P. The pressing portion 1441P is a portion that is pressed against the FPC board 740.

Figure 17:
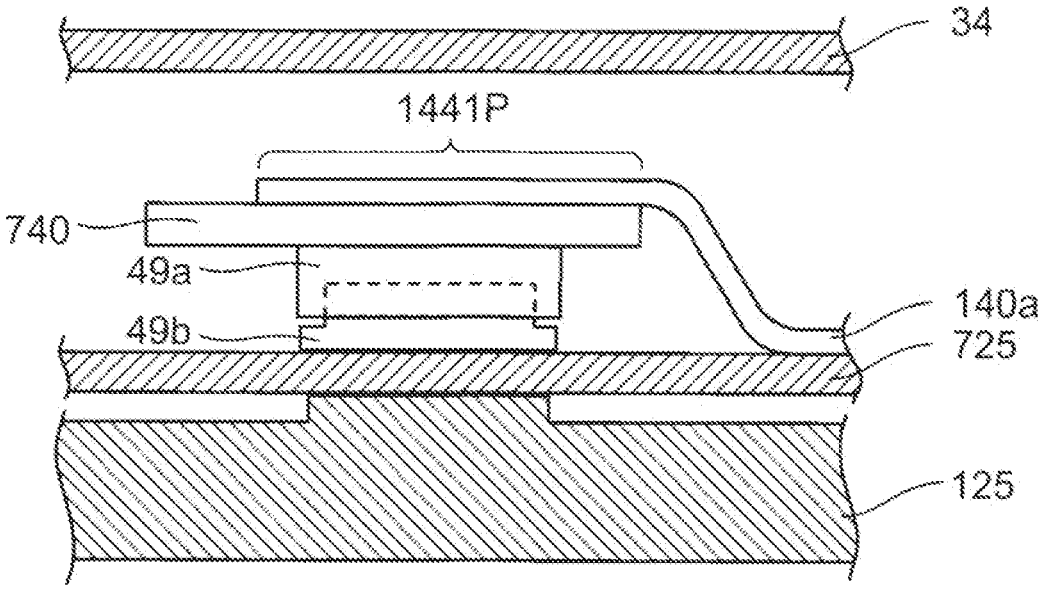
FIG. 17 is a sectional view illustrating a detailed configuration near a pressing portion.

FIG. 17 is a sectional view illustrating a detailed configuration near the pressing portion 1441P. As illustrated in FIG. 17, the pressing portion 1441P presses the power supply connector 49*a* against the power supply connector 49*b* in a direction from the rear cover 34 toward the main plate 125.

Hereinabove, the electronic timepiece according to the third embodiment has been described.

According to the third embodiment, it is possible to check connection between the power supply connector 49*b* and the power supply connector 49*a* by checking conduction between the conduction check terminal 725C and the conduction check terminal 740C. For example, when the electronic timepiece is assembled or when the electronic timepiece is maintained, a person who wishes to check conduction brings a tip end of one lead rod of a tester into contact with the conduction check terminal 725C, and brings a tip end of the other lead rod of the tester into contact with the conduction check terminal 740C. The person who wishes to check the conduction can check a value displayed on the tester, so that whether or not the power supply connector 49*a* is connected to the power supply connector 49*b* can be determined.

In order to bring the tip end of the one lead rod of the tester into contact with the conduction check terminal 725C, as illustrated in FIG. 16, in a plan view along the normal direction Z, it is preferable that the conduction check terminal 725C does not overlap the FPC board 740 and the antenna holder 140. Similarly, it is preferable that the conduction check terminal 740C does not overlap the antenna holder 140 in a plan view along the normal direction Z.

Hereinabove, although the first embodiment to the third embodiment have been described, other embodiments can be conceived. For example, the other embodiments will be described as follows.

(1) In the above-described embodiments, the first steps 40K may be provided at three positions around the radiation element 41 of the patch antenna 40, which is merely one example. The first step 40K may be provided at two or more positions.

(2) In the above-described embodiments, although the invention is applied to an analog electronic timepiece having a pointer and a dial plate 11, the invention can be applied to an electronic device other than an analog electronic timepiece having a plan antenna, for example, a wearable device having a time display function.

(3) In the above-described embodiments, although the case body 35 is made of metal, the entire case body 35 is not limited to metal, and a part of the case body 35 may be made of metal. For example, plastic may be used as a part of a component constituting the case body 35.

(4) In the above-described embodiments, although the patch antenna 40 is an example of an antenna, the patch antenna 40 is not limited thereto. For example, the antenna may be a ring antenna or a plate-inverted F type antenna. The ring antenna is an annular antenna. The annular shape is a circle or a substantially quadrangle. The plate-inverted F-type antenna has a ground electrode, a radiation element, and a short-circuit portion for short-circuiting the ground electrode and the radiation element.

(5) In the above-described embodiments, although the antenna holder 140 is made of metal, surface treatment such as gold plating may be applied to the antenna holder 140 in order to reduce a contact resistance between the antenna holder 140 and the rear cover 34. Further, as illustrated in FIGS. 9A and 9B, the antenna holder 140 has the legs 1451 and 1452 folded in a direction of the rear cover 34. However, like the antenna holder 140*a* illustrated in FIG. 16, the antenna holder 140 may have more than two legs folded in the direction of the rear cover 34. As the number of legs folded in the direction of the rear cover 34 is larger, the contact resistance between the antenna holder 140 and the rear cover 34 can be reduced.

(6) In the second embodiment and the third embodiment, although the antenna holder 140 presses the power supply connector 49*a* against the power supply connector 49*b* in the direction from the rear cover 34 to the main plate 125, the invention is not limited thereto. In detail, in a plan view along the normal direction Z, the power supply connector 49*a* and the power supply connector 49*b* may be configured to overlap the antenna holder 140, and the antenna holder 140 may not press the power supply connector 49*a*. For example, the antenna holder 140 may be in contact with the FPC board 740. Further, the antenna holder 140 may be separated from the FPC board 740. When the antenna holder 140 is separated from the FPC board 740, it is preferable that the shortest distance between the antenna holder 140 and the FPC board 740 is shorter.

According to the above-described configuration, when the antenna holder 140 and the FPC board 740 are in contact with each other, even when a force for separation from the power supply connector 49*b* is applied to the power supply connector 49*a* due to the impact or vibration on the electronic timepiece, a normal force corresponding to the above-described separation force can be generated from the antenna holder 140, and the power supply connector 49*a* can be prevented from being separated from the power supply connector 49*b*.

Further, even when the antenna holder 140 and the FPC board 740 are separated from each other, when a distance between the antenna holder 140 and the FPC board 740 is short, the antenna holder 140 or the FPC board 740 moves due to the impact or vibration on the electronic timepiece, and the antenna holder 140 and the FPC board 740 come into contact with each other. In this case, even when a force for separation from the power supply connector 49*b* is applied to the power supply connector 49*a* due to the impact or vibration on the electronic timepiece, a normal force corresponding to the above-described separation force can be generated from the antenna holder 140, and the power supply connector 49*a* can be prevented from being separated from the power supply connector 49*b*.

However, as illustrated in the second embodiment, the antenna holder 140 presses the power supply connector 49*a* against the power supply connector 49*b* in a direction from the rear cover 34 to the main plate 125, so that the separation force is relaxed or canceled out due to a normal stress caused by the pressing of the antenna holder 140. Thus, separation of the power supply connector 49*a* from the power supply connector 49*b* can be suppressed, as compared to a case where the antenna holder 140 is not pressed.

The entire disclosures of Japanese Patent Application No. 2018-039611, filed Mar. 6, 2018, and No. 2018-212164, filed Nov. 12, 2018 are expressly incorporated by reference herein.

What is claimed is:

1. An electronic timepiece comprising:

a cylindrical case;

a rear cover that covers an opening of the case;

an antenna having a first surface facing away from the rear cover and a second surface facing the rear cover, a main plate that is fixed to the case; and an antenna holder that presses the antenna against the main plate in a direction from the rear cover to the main plate, wherein the antenna has a radiation element provided on the first surface and a first step provided on the first surface, and wherein the main plate has a second step provided at a position corresponding to the first step.

2. The electronic timepiece according to claim 1, wherein at least a part of the case is made of metal, wherein the antenna holder is made of metal, and wherein the antenna holder is electrically connected to the case.

3. The electronic timepiece according to claim 1, wherein the rear cover and the antenna holder are made of metal, and the antenna holder is electrically connected to the rear cover.

4. The electronic timepiece according to claim 3, further comprising:

a flexible board having a first ground electrode provided on a surface closer to the antenna than to the rear cover and a second ground electrode provided on a surface closer to the rear cover than to the antenna, the flexible board being disposed between the antenna and the rear cover, wherein the antenna has a third ground electrode, wherein the first ground electrode and the third ground electrode are connected to each other, and wherein the second ground electrode and the rear cover are electrically connected to each other through the antenna holder.

5. The electronic timepiece according to claim 1, further comprising:

a flexible board on which the antenna is mounted; and a circuit board on which a circuit that performs communication using the antenna is provided and which is electrically connected to the flexible board.

6. The electronic timepiece according to claim 5, wherein the flexible board and the circuit board are electrically connected to each other through a first power supply connector mounted on the flexible board and a second power supply connector mounted on the circuit board.

7. The electronic timepiece according to claim 6, wherein in a plan view along a normal direction of the first surface, the first power supply connector and the second power supply connector overlap with the antenna holder.

8. The electronic timepiece according to claim 7, wherein the antenna holder presses the first power supply connector against the second power supply connector in a direction from the rear cover to the main plate.

9. The electronic timepiece according to claim 5, wherein the flexible board and the circuit board are electrically connected to each other by bringing a first power supply electrode provided on the flexible board and a second power supply electrode provided on the circuit board into contact with each other.

10. The electronic timepiece according to claim 5, wherein in a plan view along a normal direction of the first surface, the circuit board and the antenna do not overlap each other.

11. The electronic timepiece according to claim 1, further comprising:

a dial plate provided to face the first surface, wherein a distance between the first surface and the dial plate is longer than a distance between a placement surface of a date wheel and the dial plate in the main plate.

12. The electronic timepiece according to claim 1, wherein the antenna is a patch antenna.

* * * * *